US009039003B2

(12) United States Patent
Egli et al.

(10) Patent No.: US 9,039,003 B2
(45) Date of Patent: May 26, 2015

(54) METHOD OF, AND APPARATUS FOR, PROCESSING SHEETS OF DIFFERENT FORMATS

(71) Applicants: Toni Egli, Hochdorf (CH); Stephan Riedel, Zurich (CH)

(72) Inventors: Toni Egli, Hochdorf (CH); Stephan Riedel, Zurich (CH)

(73) Assignee: HUNKELLER AG, Wikon (CH)

( * ) Notice: Subject to any disclaimer, the term of this patent is extended or adjusted under 35 U.S.C. 154(b) by 0 days.

(21) Appl. No.: 14/199,252

(22) Filed: Mar. 6, 2014

(65) Prior Publication Data

US 2014/0183809 A1 Jul. 3, 2014

Related U.S. Application Data

(62) Division of application No. 13/427,154, filed on Mar. 22, 2012, now Pat. No. 8,708,326.

(30) Foreign Application Priority Data

Mar. 24, 2011 (EP) ..... 11405236

(51) Int. Cl.
*B41F 13/64* (2006.01)
*B65H 29/51* (2006.01)
(Continued)

(52) U.S. Cl.
CPC ..... *B41F 13/64* (2013.01); *B65H 29/51* (2013.01); *B65H 39/02* (2013.01); *B65H 39/105* (2013.01); *B65H 2301/141* (2013.01); *B65H 2301/22* (2013.01); *B65H 2301/4213* (2013.01); *B65H 2301/4312* (2013.01); *B65H 2404/42* (2013.01);
(Continued)

(58) Field of Classification Search
USPC ..... 270/6, 10, 13, 19, 38, 42, 43, 47, 52.14, 270/52.16, 52.19, 52.21, 58.01, 58.29, 60
See application file for complete search history.

(56) References Cited

U.S. PATENT DOCUMENTS 3,203,326 A 8/1965 Obenshain
3,272,044 A 9/1966 Obenshain
(Continued)

FOREIGN PATENT DOCUMENTS

EP 1 464 603 A1 10/2004
EP 1 471 022 A1 10/2004
EP 1 857 390 A1 11/2007

OTHER PUBLICATIONS

Jul. 1, 2013 Office Action in U.S. Appl. No. 13/427,154.
Sep. 6, 2013 Office Action in U.S. Appl. No. 13/427,154.
Dec. 17, 2013 Notice of Allowance in U.S. Appl. No. 13/427,154.

*Primary Examiner* — Leslie A Nicholson, III
(74) *Attorney, Agent, or Firm* — Oliff PLC

(57) ABSTRACT

An apparatus for processing sheets of different formats, the apparatus including a feeding device that feed sheets of different formats in a feeding direction one behind the other, and at a certain conveying speed, at least two collecting drums disposed downstream of the feeding device, the at least two collecting drums having cylindrical lateral surfaces that rotate about an axis of rotation, securing means for temporarily securing the fed sheets on a circumference of the at least two collecting drums, a drive device that drives the collecting drums in rotation at a circumferential speed that corresponds to the conveying speed of the feeding device, and a sensing device for sensing the sheets of different formats moving past is arranged along the conveying path and senses the leading edge of the sheets of different formats, as seen in the feeding direction, or markings applied to the sheets of different formats.

4 Claims, 10 Drawing Sheets

(51) Int. Cl.

| | |
|---|---|
| ***B65H 39/02*** | (2006.01) |
| ***B65H 39/105*** | (2006.01) |
| ***B65H 39/00*** | (2006.01) |

(52) U.S. Cl.

CPC ..... *B65H 2404/652* (2013.01); *B65H 2405/541* (2013.01); *B65H 2511/11* (2013.01); *B65H 2513/42* (2013.01); *B65H 2701/1131* (2013.01); *B65H 39/00* (2013.01)

(56) References Cited

U.S. PATENT DOCUMENTS

| | | | |
|---|---|---|---|
| 3,995,848 | A | 12/1976 | Obenshain |
| 7,618,040 | B2 | 11/2009 | Mahler et al. |
| 7,934,712 | B2 | 5/2011 | Boss |
| 2008/0048381 | A1 | 2/2008 | Mahler et al. |
| 2010/0244371 | A1 | 9/2010 | Suh |

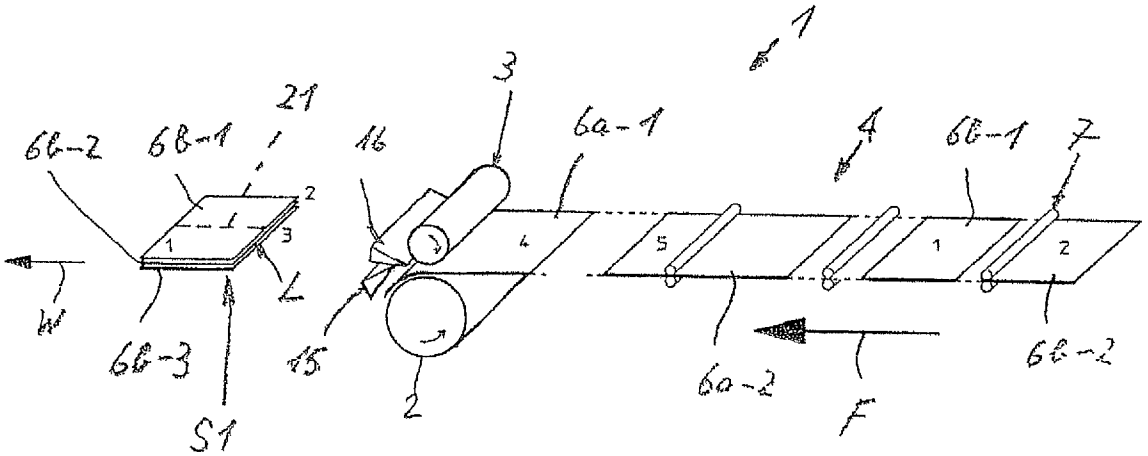
Fig. 4C
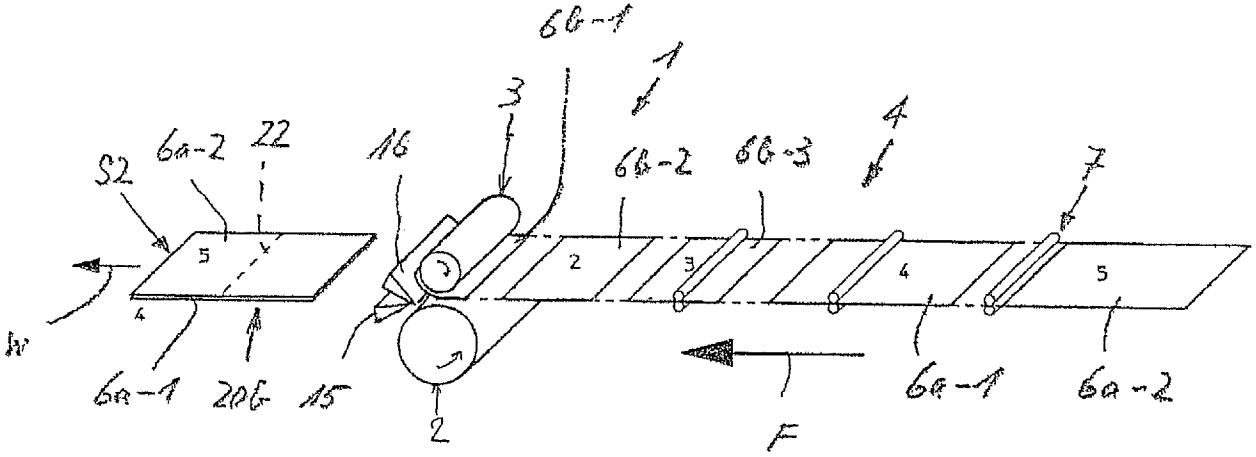
Fig. 4d
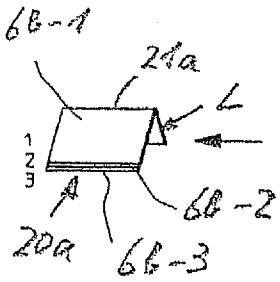

1
3
4
5
6a-1
6a-2
6b-1
6b-2
6b-3
7
15
16
18
20a
20b
21
21a
22a
23
23a
E
W

METHOD OF, AND APPARATUS FOR, PROCESSING SHEETS OF DIFFERENT FORMATS

This is a divisional of U.S. application Ser. No. 13/427,154 filed Mar. 22, 2012, which claims priority to European Application No. 11 405 236.8 filed on Mar. 24, 2011. The entire disclosures of the prior applications are hereby incorporated herein by reference in their entirety.

BACKGROUND

Collecting apparatuses of this type are disclosed, for example, in EP 1 471 022 A1 and EP 1 857 390 A1. These known collecting apparatuses have a collecting drum which can be driven in rotation, to which the sheets which are to be processed are fed by means of a feeding device and on which the sheets, which are fed one behind the other, are secured temporarily and collected to form sheet stacks. The sheets are secured on the circumference of the collecting drums by mechanical securing devices or by means of electrostatic forces of attraction. In order for it to be possible to process sheets of different formats, i.e. of different format lengths, the circumferential speed of the collecting drum and/or the feeding speed of the feeding device has to be altered and adapted to the varying format lengths. This requires corresponding outlay in terms of regulating equipment.

SUMMARY

It is an object of exemplary embodiments to provide a method and an apparatus that allow sheets of different formats that arrive one behind the other to be processed without overly high technical outlay.

The concept according to exemplary embodiments provides for at least two collecting drums, of which each serves to secure one or more sheets temporarily on its circumference. The collecting drums are driven at a circumferential speed, which corresponds to the feeding speed of the sheets. It is thus possible for sheets of different formats or different format lengths which arrive one behind the other, as seen in the feeding direction, to be processed continuously without the circumferential speed of the collecting drums and/or the feeding speed of the sheets having to be regulated.

The one collecting drum is preferably arranged above the conveying path for the sheets, the conveying path being defined by the feeding device, and the other collecting drum is arranged beneath the conveying path. The collecting drums, in this case, are driven in opposite directions of rotation.

According to the preferred embodiments, newspapers, periodicals, brochures and the like comprising sheets which are printed on both sides, printing preferably having taken place in a digital printing machine, can be produced, in particular, in a cost-effective manner. The individual sheets of newspapers, periodicals, brochures and the like are printed usually with four pages of text and/or images (referred to hereinbelow as double sheets) and, following collection on the collecting cylinders, are folded in the center. In particular newspapers, however, may also contain sheets that are of only half the format length in relation to the other sheets and have been printed with two pages of text and/or images (referred to hereinbelow as single sheets). Such newspapers can be produced particularly straightforwardly with the aid of the method according to the invention and by means of the apparatus according to the invention. This also applies to newspapers that contain a supplement comprising one or more pages. In this case, the sheets of the supplement can be collected on the one collecting drum to form a first sheet stack and the sheets of the newspaper can be collected on the other collecting cylinder to form a second sheet stack. If a third collecting drum is used, it is possible to produce newspapers that comprise, as described above, double and single sheets and contain a supplement in addition. The sheets of the supplement here are collected preferably on the third collecting drum.

The method and the apparatus according to the preferred embodiments, however, can also be used to produce other products which comprise sheets printed in a digital printing machine, e.g. calendars, lottery tickets and the like. In the case of calendars and lottery tickets, however, the sheets are printed only on one side.

BRIEF DESCRIPTION OF THE DRAWINGS

Various exemplary embodiments of the subject matter of the preferred embodiments will be described in more detail hereinbelow with reference to the drawings, in which, purely schematically.

DETAILED DESCRIPTION OF EMBODIMENTS

Figure 1:
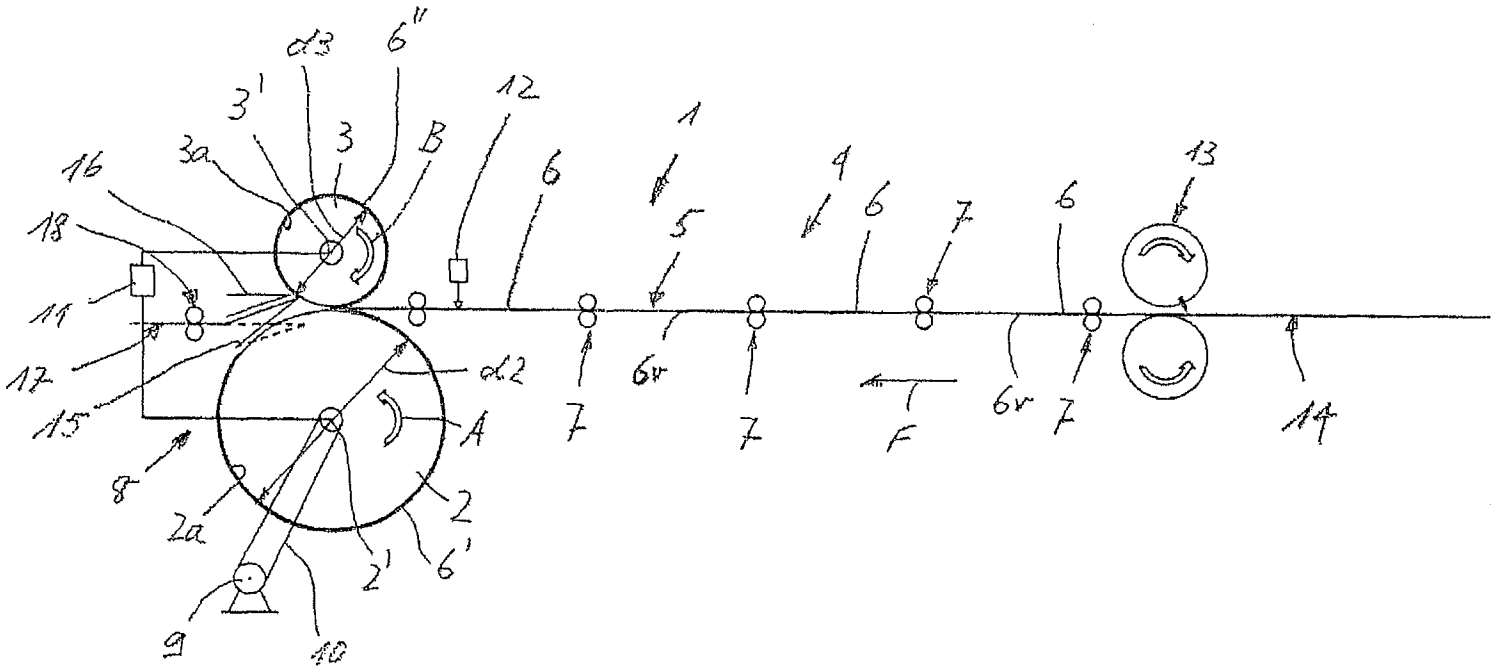
FIG. 1 shows a side view of a first embodiment of a processing apparatus according to the invention with a cross-cutting apparatus disposed upstream.

The first embodiment of a sheet-processing apparatus 1, which is illustrated purely schematically in FIG. 1, has two collecting drums 2, 3, which can be driven in a rotatable manner, have cylindrical lateral surfaces and axes of rotation designated by 2' and 3', respectively. The collecting drum 2 here is driven in the direction of the arrow A and the collecting drum 3 is driven in the direction of the arrow B, i.e. in opposite directions. In the case of the present embodiment, the diameter d2 of the one collecting drum 2 is larger than the diameter d3 of the other collecting drum 3. The diameter d2 may be, for example, double the size of the diameter d3. The collecting drums 2, 3 have disposed upstream of them a feeding device 4, which defines a conveying path 5 for the sheets 6. The collecting drums 2, 3 are located opposite one another in relation to the conveying path 5, wherein, in the case of the present exemplary embodiment, the collecting drum 2 with the larger diameter d2 is arranged beneath this conveying path 5. However, it is also possible for the collecting drum 2 to be arranged above the conveying path 5 and for the collecting drum 3 to be arranged beneath the conveying path 5.

The feeding device 4 has a number of conveying-roller pairs 7, which are driven in a manner which is known per se (but not illustrated specifically) such that the sheets 6 are conveyed in a feeding direction F one behind the other to the collecting drums 2, 3 at a certain, essentially constant feeding speed v. Instead of the conveying-roller pairs 7, it is also possible to use other suitable conveying means, e.g. a vacuum belt or a conveying belt provided with drivers. The collecting drums 2, 3 are driven by means of a drive arrangement 8 (illustrated only schematically) such that the circumferential speed u of each collecting drum 2, 3 is essentially equal to the feeding speed v. The drive arrangement 8 has a drive motor 9, which drives the lower collecting drum 2 via a drive element 10 (for example a drive belt or chain). This lower collecting drum 2 is drive-connected to the upper collecting drum 3 via a transmission 11.

A sensing device 12, for sensing the sheets 6 moving past, is arranged along the conveying plane 5, and senses, for example, the leading edge 6*v* of the sheets 6, as seen in the feeding direction F, or markings applied to the sheets 6. The sensing device 12 is connected to a control means (not illustrated).

The sheets 6 are severed from a continuously fed material web 14 by means of a cross-cutting device 13 of known construction. In the case of the exemplary embodiment shown, the sheets 6 have been printed, wherein printing of the sheets 6 or of the material web 14 takes place preferably in a digital printing machine If the sheets 6 form a constituent part of a newspaper, periodical, brochure or the like, then they are printed usually on both sides. If the sheets are processed further to form other kinds of product, then they may also be printed just on one side.

The two collecting cylinders 2, 3 are provided with securing means (not illustrated), which secure the fed sheets 6 temporarily on the circumference 2*a*, or 3*a*, of the collecting drums 2, or 3, as is illustrated in FIG. 1 by the sheets 6' and 6". The securing means may be, for example, a mechanical securing mechanism, as is described in EP 1 471 022 A1, or may be formed by a securing arrangement which operates with mechanical means or with electrostatic charging, as is disclosed in EP 1 857 390 A1. For the description of the functioning of these known securing means, reference is made to the aforementioned EP 1 471 022 A1 and EP 1 857 390 A1. The sheets 6 can be collected on the collecting drums 2, 3 to form sheet stacks, which comprise a plurality of sheets 6 located one above the other, as is explained in more detail in the aforementioned documents EP 1 471 022 A1 and EP 1 857 390 A1. However, the sheets 6 may also be secured temporarily on the circumference 2*a*, 3*a* of the collecting drums 2, 3 by securing means other than those mentioned above.

Detaching elements 15 and 16 (illustrated only schematically) are present for the purpose of detaching the sheets 6 or the sheet stacks from the collecting drums 2 and 3, it being possible for the detaching elements to be shifted independently of one another, and in a manner which is not illustrated, from an inactive position into an active position and vice versa. In the active position, the detaching elements 15, 16 detach a sheet 6 or a sheet stack from the associated collecting drum 2 and 3 and direct the detached sheet 6 or the detached sheet stack to a removal device 17, which may be designed, for example, in the same way as the feeding device 4 and has driven conveying-roller pairs 18 or other kinds of conveying means.

FIGS. 2 to 4 will be used hereinbelow to explain possible variants in the operation of the apparatus according to FIG. 1. The sheet-processing apparatus 1 is illustrated in simplified form in these FIGS. 2 to 4. Thus, for example, the drive arrangement 8 for the collecting drums 2, 3 and the cross-cutting apparatus 13 have been omitted. Furthermore, it is assumed that the sheets 6 have been printed on both sides. This is not absolutely necessary, however, because the sheets 6 may also be printed just on one side or have no printing at all.

In the case of all the variants shown in FIGS. 2 to 4, sheets 6*a* of a first format and sheets 6*b* of a second format, which differs from the first format, are processed. The widths x of the sheets 6*a*, 6*b* are equal, these widths running transversely to the feeding direction F, whereas the sheets 6*a* are of a format length y1, extending in the feeding direction F, which is greater than the format length y2 of the sheets 6*b*. In the case of the variants shown, the format length y1 is approximately double the size of the format length y2. The format width x and the format lengths y1 and y2 are depicted only in FIG. 2*a*, but are representative of the rest of the figures. For the sake of simplicity, a sheet 6*a* will be referred to hereinbelow as a "long sheet" and a sheet 6*b* will be referred to hereinbelow as a "short sheet". As illustrated in FIGS. 2 to 4, the sheets 6*a*, 6*b* are fed to the collecting drums 2, 3 one behind the other, as seen in the feeding direction F.

In the case of the first variant in the operation of the sheet-processing apparatus 1, this first variant being illustrated in FIGS. 2*a* to 2*d*, in each case two long sheets 6*a* and a short sheet 6*b* are brought together to form an end product or interim product. FIGS. 2*a* to 2*d* show situations that follow one after the other chronologically.

Figure 2A:
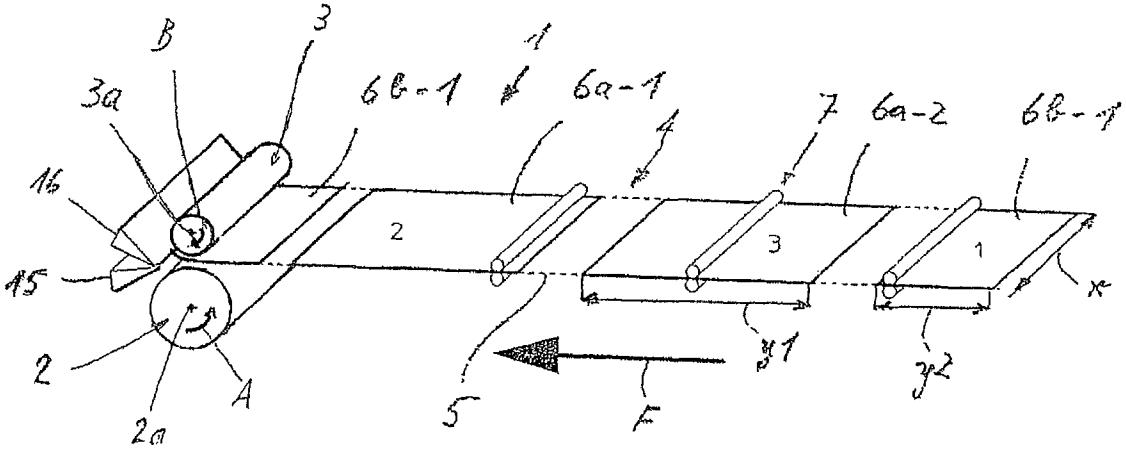
FIGS. 2*a*-2*d* show side views, in perspective, of various phases of a first possible manner of operation of the processing apparatus according to FIG. 1, FIGS. 3*a*-*d* show side views, in perspective, of various phases of a second possible manner of operation of the processing apparatus according to FIG. 1, FIGS. 4*a*-*f* show side views, in perspective, of various phases of a third possible manner of operation of the processing apparatus according to FIG. 1.
Figure 2B:
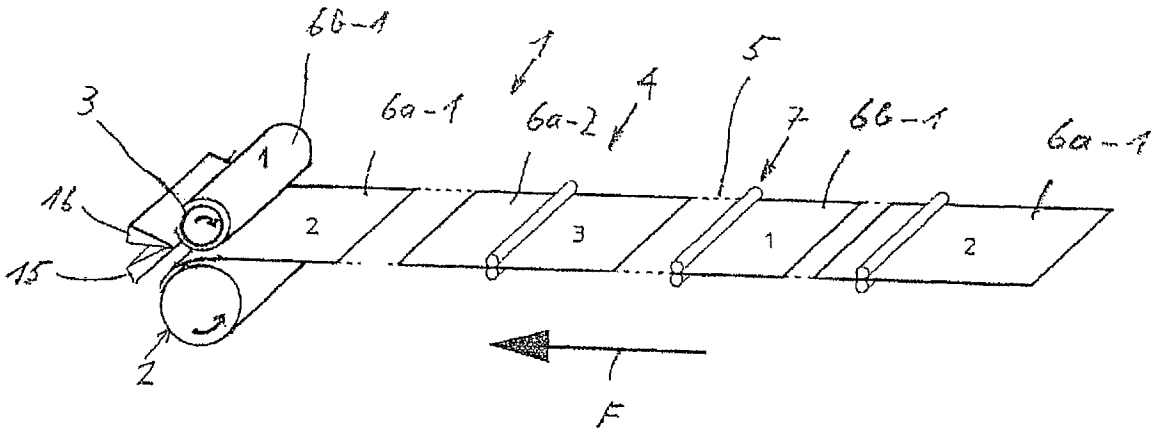
Figure 2C:
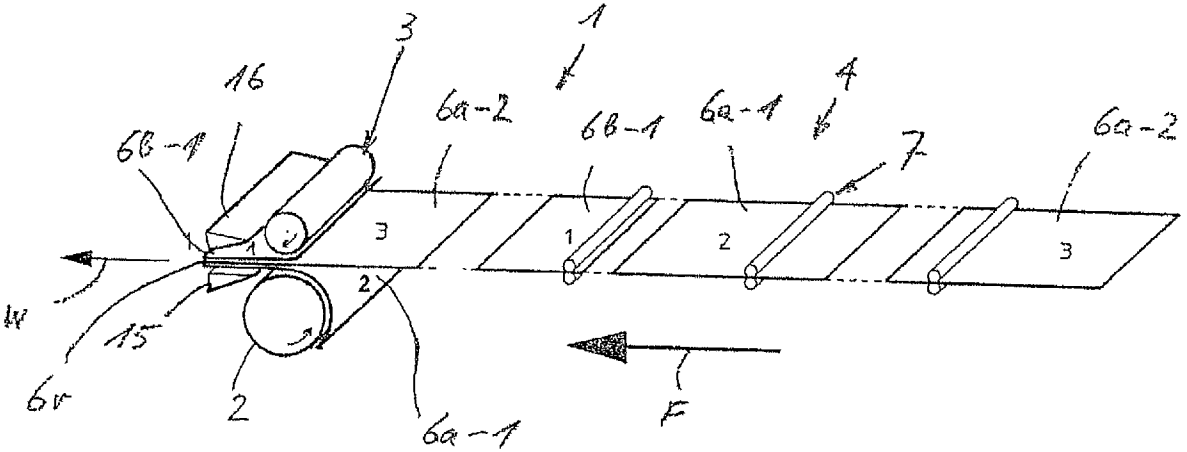
Figure 2D:
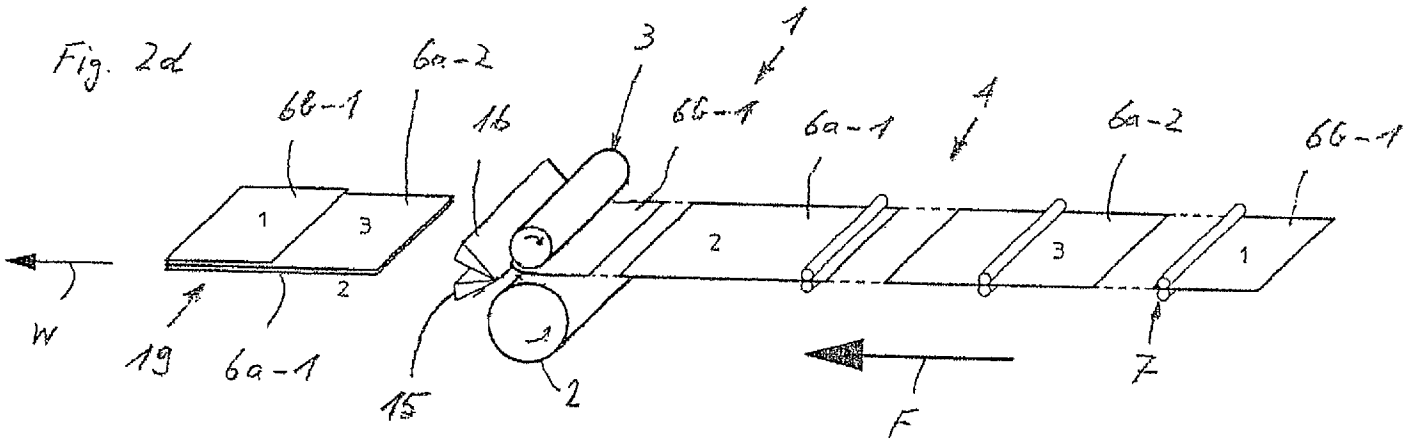

As FIG. 2*a* shows, the short sheet 6*b*-1 is wound up onto the upper collecting drum 3 and secured on the circumference thereof. According to FIG. 2*b*, the short sheet 6*b*-1 has been wound up fully onto the collecting drum 3, while the following, long sheet 6*a*-1 is wound up onto the lower collecting drum 2 and secured on the circumference thereof. As FIG. 2*c* shows, the second long sheet 6*a*-2 is then guided through between the collecting drums 2, 3. This second long sheet 6*a*-2 is brought together, at the same time, with the first long sheet 6*a*-1 and the short sheet 6*b*-1 such that the leading edges 6*v* of the three sheets 6*a*-1, 6*a*-2 and 6*b*-1 are aligned with one another. The sheets 6*a*-1 and 6*b*-1 are detached from the associated collecting drums 2 and 3, respectively, by means of the detaching elements 15 and 16, respectively. FIG. 2*d* illustrates how the product 19 formed from the sheets 6*a*-1, 6*a*-2 and 6*b*-1 is removed in the direction of the arrow W. The following sheets 6*b*-1, 6*a*-1 and 6*a*-2 are then processed as described above.

By virtue of the sheets 6*a*-1 and 6*a*-2 located one above the other being folded along their center line, which runs transversely to the removal direction W, it is possible to obtain a product 19 in the case of which the short sheet 6*b*-1 is located between the folded long sheets 6*a*-1 and 6*a*-2. Such a product 19 may be, for example, a newspaper or a newspaper section, i.e. part of a newspaper, in the case of which the long sheets 6*a*-1 and 6*a*-2 have been printed in each case with four pages of text and/or images and the short sheets 6*b*-1 have been printed with two pages of text and/or images.

FIGS. 3*a* to 3*d* show a second variant in the operation of the sheet-processing apparatus 1, in the case of which, in the same way as for the first variant according to FIGS. 2*a* to 2*d*, in each case a short sheet 6*b*-1 and two long sheets 6*a*-1 and 6*a*-2 are put together to form a product 19, albeit a differently constructed one.

Figure 3A:
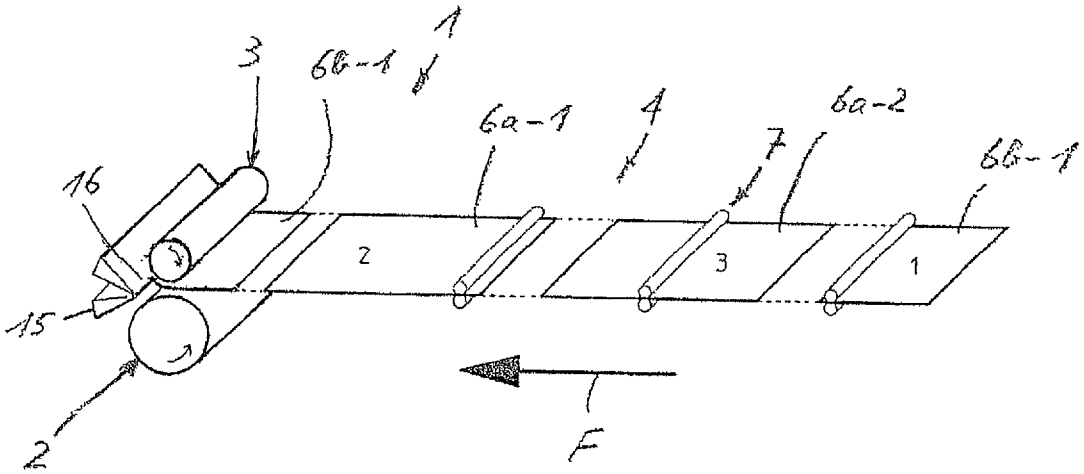
Figure 3B:
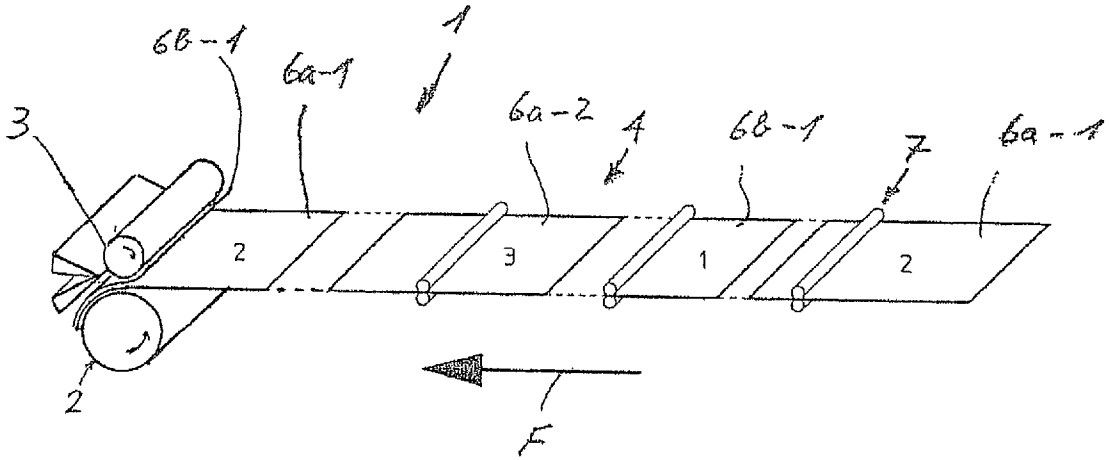
Figure 3C:
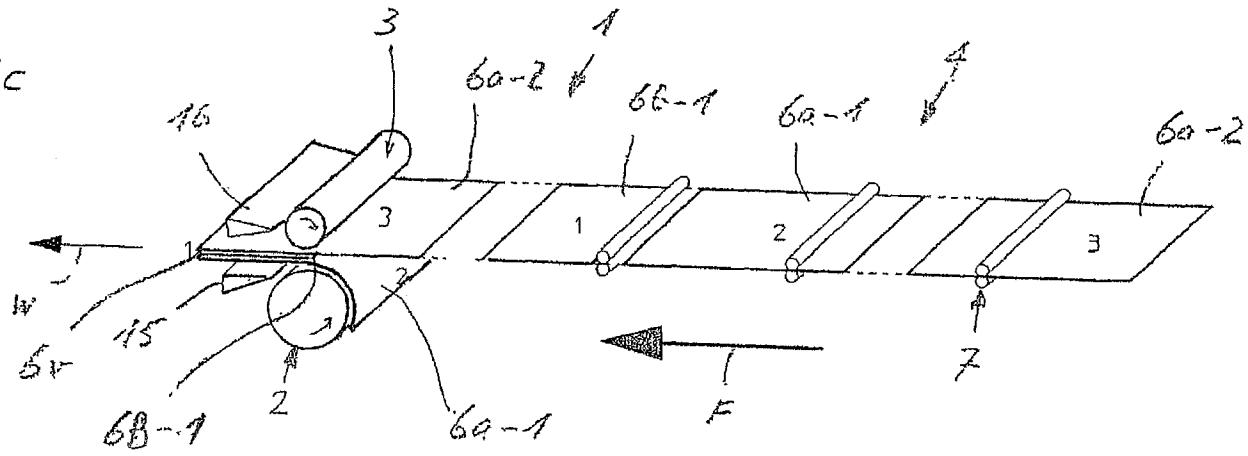
Figure 3D:
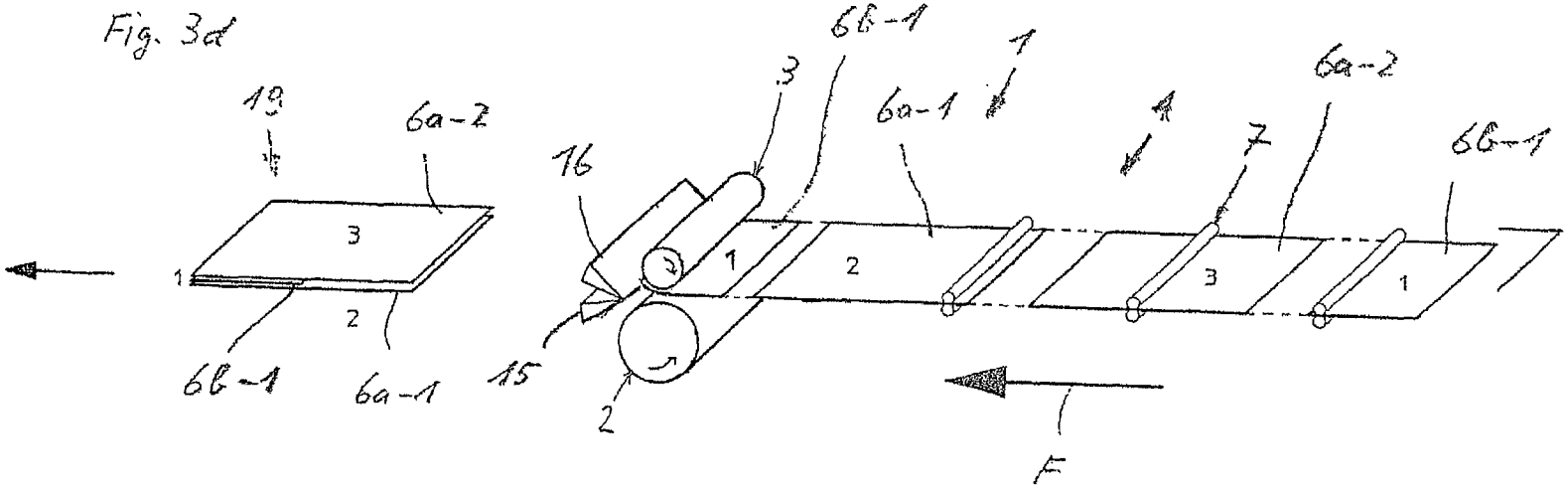

The situations illustrated in FIGS. 3*a* and 3*b* correspond to the situations explained with reference to FIGS. 2*a* and 2*b*. In the case of the situation illustrated in FIG. 3*b*, the short sheet 6*b*-1 is detached from the collecting drum 3, and brought together with the following, long sheet 6*a*-1, at an earlier stage than is shown in FIG. 2*b*. The second long sheet 6*a*-2 is then brought together with the sheets 6*a*-1 and 6*b*-1 located one upon the other (FIG. 3*c*). The operation of positioning the sheets 6*a*-1, 6*b*-1 and 6*a*-2 one upon the other likewise takes place such that the leading edges 6*v* thereof are aligned with one another. The situation shown in FIG. 3*d* corresponds to the situation according to FIG. 2*d*, with the exception that the product 19 has been put together differently and comprises the short sheet 6*b*-1 located between the long sheets 6*a*-1 and 6*a*-2.

In the case of the third variant in the operation of the sheet-processing apparatus 1, this third variant being illustrated in FIGS. 4*a* to 4*f*, in each case three short sheets 6*b* and two long sheets 6*a*, which are fed in the feeding direction F one behind the other to the collecting drums 2, 3, are brought together first of all to form interim products and then to form an end product. FIGS. 4*a* to 4*f* show, in the same way as the illustrations of FIGS. 2*a* to 2*d* and 3*a* to 3*d*, situations that follow one after the other chronologically.

Figure 4A:
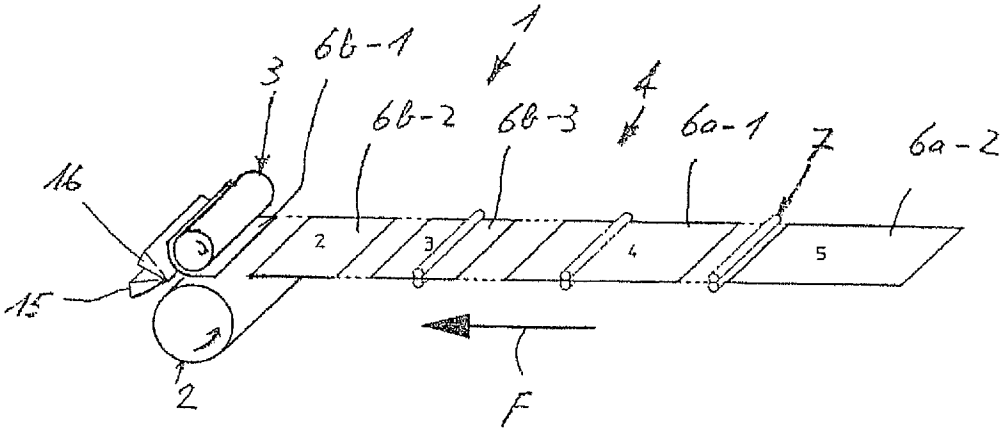
Figure 4B:
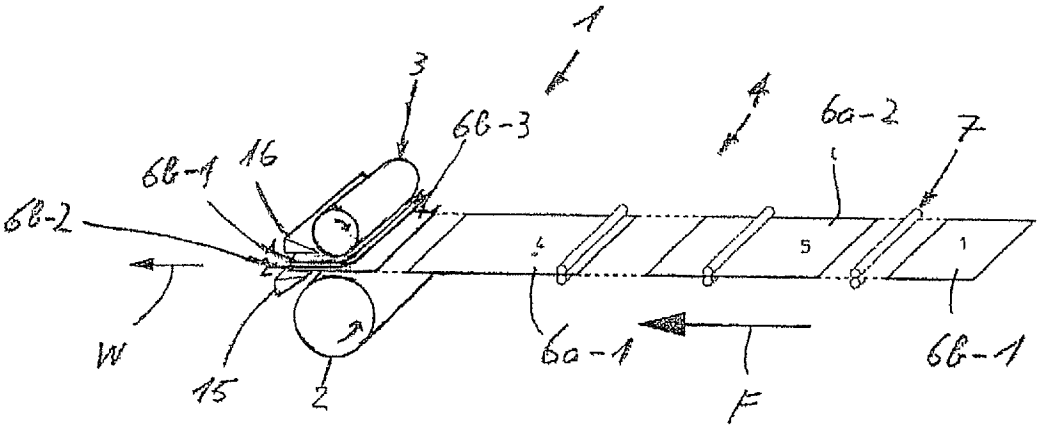

As FIGS. 4*a* and 4*b* show, the short sheets 6*b*-1 and 6*b*-2 are wound up onto the upper collecting drum 3, and secured on the circumference thereof, such that the sheets 6*b*-1, 6*b*-2 are aligned by way of their side edges. The first short sheet 6*b*-1 here revolves along with the collecting drum 3 more than once. The third incoming short sheet 6*b*-3 is brought together with the sheets 6*b*-1 and 6*b*-2, now detached from the collecting drum 3, such that all three short sheets 6*b*-1, 6*b*-2 and 6*b*-3 are aligned with one another by way of their side edges (FIG. 4*b*).

As FIG. 4*c* shows, the short sheets 6*b*-1, 6*b*-2, 6*b*-3, which are located one above the other and form a first sheet stack S1, are removed in the direction of the arrow W, while the long sheet 6*a*-1 is wound up onto the lower collecting drum 2 and secured on the circumference thereof. The next incoming long sheet 6*a*-2 is brought together with the sheet 6*a*-1, now detached from the collecting drum 2, such that the two long sheets 6*a*-1 and 6*a*-2 are aligned with one another by way of their side edges. The short sheets 6*b*-1, 6*b*-2 and 6*b*-3 of the first sheet stack S1 may be connected to one another along the longitudinal edge designated by L, this being done preferably by means of an adhesive, which has been applied to the sheets 6*b*-1, 6*b*-2, 6*b*-3, for example, as they are collected on the collecting drum 3. In the case of the production of newspapers, periodicals, brochures and the like, the sheets 6*b*-1, 6*b*-2, 6*b*-3 of the sheet stack S1, however, are connected to one another usually along the later folding line 21, which extends in the removal direction W.

In the case of the situation shown in FIG. 4*d*, the first sheet stack S1, formed from the short sheets 6*b*-1, 6*b*-2, 6*b*-3, has been folded along the folding line 21 (see FIG. 4*c*). In this FIG. 4*d*, the resulting folding edge is designated by 21*a* and the folded sub-product is designated by 20*a*. As FIG. 4*d* also shows, the long sheets 2*a*-1 and 2*a*-2, collected on the collecting drum 2 to form a second sheet stack S2, have been detached from the collecting drum 2 and form a second sub-product 20*b*. The sheets 2*a*-1 and 2*a*-2, which are located one above the other and are aligned with one another, are folded a first time along a first folding line 22 (see FIG. 4*d*), which runs transversely to the removal direction W, as has been illustrated in FIG. 4*e*, in which the resulting folding edge is designated by 22*a*.

In a later phase, the once-folded sub-product 20*b* is folded a second time, to be precise along a second folding line 23 (see FIG. 4*e*), which runs at right angles to the first folding edge 22*a*. The twice-folded sub-product 20*b* is positioned over the other, once-folded sub-product 20*a*, as is illustrated on the left-hand side of FIG. 4*f*. In this FIG. 4*f*, the resulting end product is designated by 19 and the second folding edge of the sub-product 20*b* is designated by 23*a*.

Figures 4E, 4F:
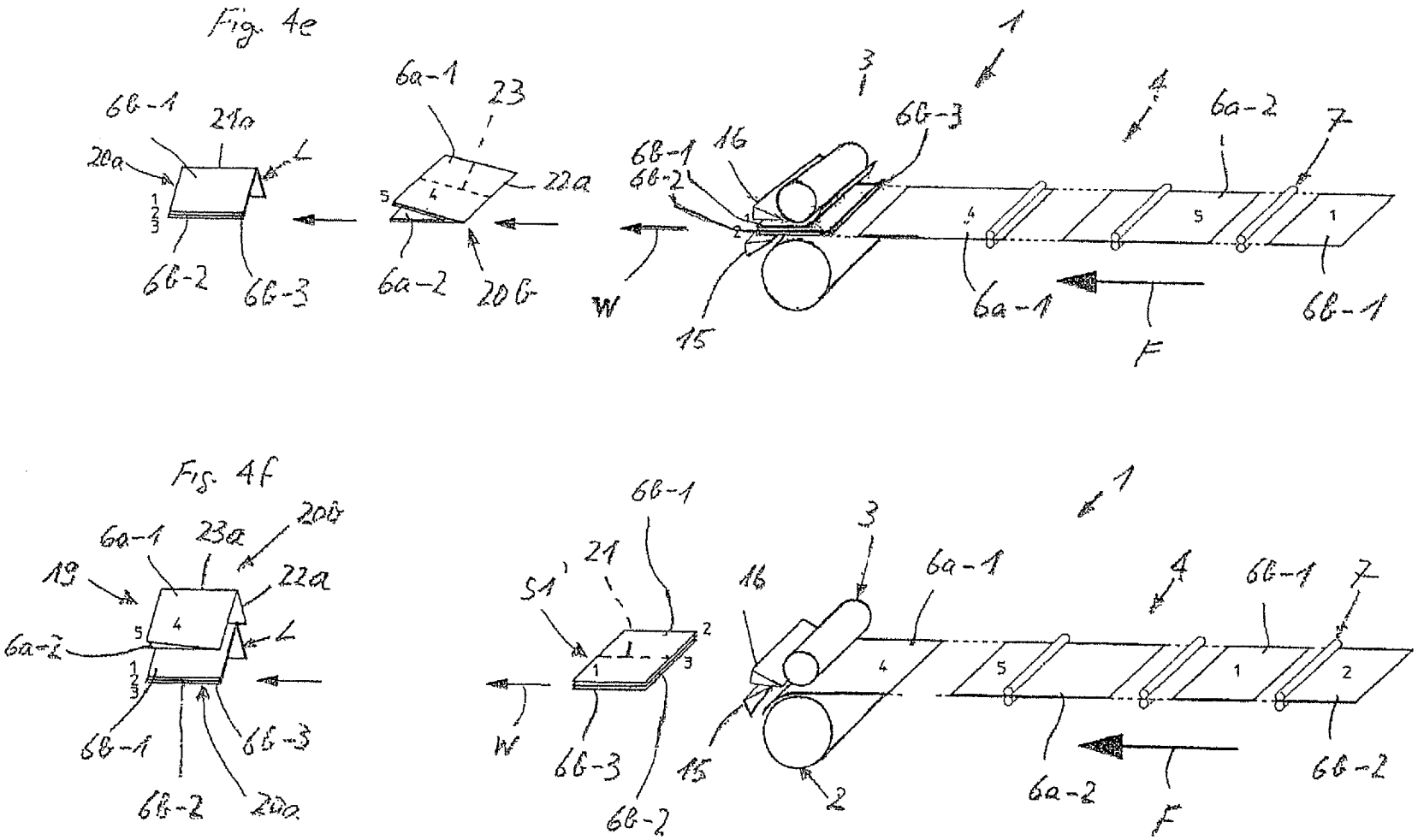

As FIGS. 4*c* to 4*f* show, the successive sheets 6*b*-1, 6*b*-2, 6*b*-3, 6*a*-1 and 6*a*-2 are processed in the manner described above to form the next sub-products 20*a* and 20*b* and then to form the next end product 19. FIG. 4*f*, which corresponds to the illustration of FIG. 4*c*, shows the first sheet stack S1' for the next sub-product 20*a*.

The end product 19 shown in FIG. 4*f* may be a newspaper comprising a supplement (magazine, brochure or the like) inserted into the actual newspaper. In this case, the sub-product 20*a* forms the supplement and the sub-product 20*b* forms the actual newspaper. All of the sheets 6*b*-1, 6*b*-2, 6*b*-3 of the sub-product 20*a* (supplement) and the sheets 6*a*-1, 6*a*-2 of the other sub-product 20*b* (newspaper) have been printed with four pages of text and/or images.

As an alternative to the exemplary embodiment shown, it is also possible, in the further processing of the sheet stacks S1 and S2, for the sub-product 20*a* not to be folded, for the other sub-product 20*b* to be folded only once about the folding line 22, and for the non-folded sub-product 20*a*, i.e. the sheet stack S1 (FIG. 4*c*), to be inserted into the once-folded sub-product 20*b* (see FIG. 4*e*).

Figure 5:
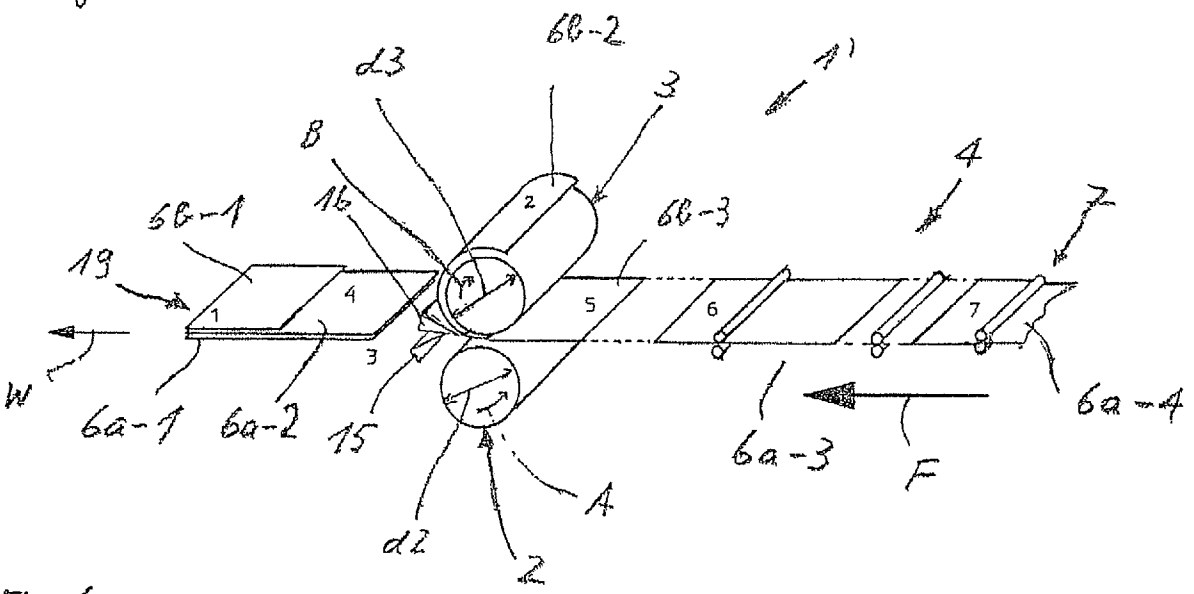
FIG. 5 shows a side view, in perspective and in an illustration that is simplified in relation to FIG. 1, of a second embodiment of a processing apparatus according to the invention.

FIG. 5 shows a side view, in perspective (corresponding to the illustrations in FIGS. 2 to 4), of a second embodiment of a sheet-processing apparatus 1' according to the invention. The sheet-processing apparatus 1' in this FIG. 5 is shown in simplified form in relation to the illustration of FIG. 1. This sheet-processing apparatus 1' according to FIG. 5, with the exception of the diameters d2, d3 of the collecting drums 2, 3, corresponds to the sheet-processing apparatus 1 shown in FIG. 1, wherein certain components, for example the drive arrangement 8, the sensing device 12 and the cross-cutting apparatus 13, have been omitted from FIG. 5. For parts that correspond to one another, the same designations have been used in FIGS. 1 and 5.

As explained above, the sheet-processing apparatus 1' illustrated in FIG. 5 differs from the sheet-processing apparatus 1 according to FIG. 1 by a different ratio between the sizes of the collecting-drum diameters d2 and d3. Thus, in the case of the sheet-processing apparatus 1' shown in FIG. 5, the two collecting-drum diameters d2 and d3 are equal. This increases the possible uses of the sheet-processing apparatus 1', because the incoming sheets 6, irrespective of their format, can be fed to the lower collecting drum 2 or the upper collecting drum 3.

Figure 6:
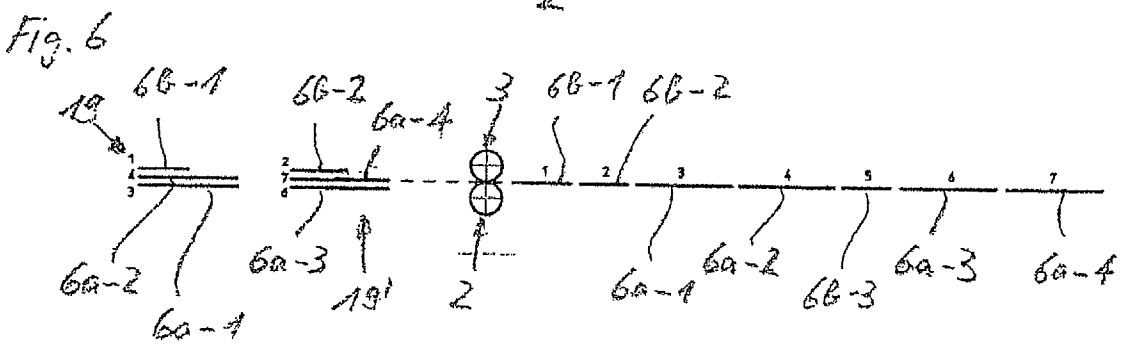
FIG. 6 shows a side view of a phase of a possible mariner of operation of the processing apparatus according to FIG. 5.

FIGS. 5 and 6 show a variant in the many possible manners of operation of the sheet-processing apparatus 1'. In the case of this variant shown, the sheets are fed to the collecting drums 2, 3, by the feeding device 4, in the following order: at the beginning of processing, two short sheets 6*b*-1 and 6*b*-2 followed by two long sheets 6*a*-1 and 6*a*-2 and then in each case a short sheet 6*b*-3 and, once again, two long sheets 6*a*-3 and 6*a*-4. In the case of the situation shown in FIG. 5, a product 19 has been produced from the long sheets 6*a*-1 and 6*a*-2, which are located one upon the other, and the first incoming short sheet 6*b*-1. This means that this product 19 is formed from sheets 6*a*, 6*b* which are not fed directly one behind the other to the collecting drums 2, 3. In order for such a product 19 to be produced, it is necessary for the lengths of the circumference of the collecting drums 2, 3 to be equal to, or greater than, double the format length y2 (see FIG. 2*a*) of the short sheets 6*b*-1, 6*b*-2, 6*b*-3. Processing of the sheets 6*a*, 6*b*, which are fed by the feeding device 4, proceeds as follows:

The two first short sheets 6*b*-1 and 6*b*-2 are wound up onto the circumference of the upper collecting drum 3, while the first incoming long sheet 6*a*-1 is wound up onto the circumference of the lower collecting drum 2. As the second long sheet 6a-2 runs through between the collecting drums 2, 3, the first short sheet 6b-1 is detached from the collecting drum 3 and the first long sheet 6a-1 is detached from the collecting drum 2, and these are brought together with the second long sheet 6a-2. The short sheet 6b-1 here is positioned on the long sheet 6a-2 from above, and the long sheet 6a-1 is positioned on the long sheet 6a-2 from beneath, such that the sheets 6b-1, 6a-2 and 6a-1 are aligned with one another by way of their leading edges.

In a corresponding manner, the short sheet 6b-2 and the long sheets 6a-3 and 6a-4 fed thereafter are used to produce a product 19' in the case of which the short sheet 6b-3 rests on the long sheet 6a-4, which for its part rests on the other long sheet 6a-3 (see also FIG. 6, which serves to clarify this manner of operation). In order to produce this product, the short sheet 6b-2 is first of all retained temporarily on the upper collecting drum 3 and then positioned on the long sheet 6a-4, while the other long sheet 6a-3, which is first of all retained temporarily on the lower collecting drum, is positioned on the sheet 6a-4 from beneath. The third short sheet 6b-3 is secured temporarily on the circumference of the upper collecting drum 3.

In the case of a variant in the above-described manner of operation, the collecting drums 2, 3 are fed always two short sheets 6b-1 and 6b-2 followed by two long sheets 6a-1 and 6a-2, to produce products 19, 19' in the case of which, as shown, in each case long sheets 6a-1, 6a-2 and 6a-3, 6a-4 and short sheets 6b-1 and 6b-2, respectively, rest one upon the other. In the case of this variant, the first short sheet 6b-1, as described, is brought together with the following long sheets 6a-1 and 6a-2, while the second short sheet 6b-2 is secured on the upper collecting drum 3 until it can be brought together with the next incoming long sheet 6a-3 and 6a-4.

As the use example explained with reference to FIGS. 5 and 6 shows, the sheet-processing apparatus 1' according to FIG. 5 can produce products which comprise sheets 6a, 6b which are not located immediately one behind the other in the sheet stream fed to the collecting drums 2, 3. This is, of course, also possible using a sheet-processing apparatus 1 according to FIG. 1.

A third embodiment of a sheet-processing apparatus 1" according to the invention will be described hereinbelow with reference to FIG. 7, the illustration of which corresponds to that in FIG. 6. This sheet-processing apparatus 1" is illustrated in simplified form in relation to the sheet-processing apparatus 1 shown in FIG. 1 and differs from the latter by the addition of a third collecting drum 25, which has an essentially cylindrical lateral surface and can be rotated about an axis of rotation. Otherwise, the sheet-processing apparatus 1" corresponds to the sheet-processing apparatus 1 according to FIG. 1. Parts that correspond to one another have the same designations in FIG. 7 as in FIGS. 1 to 6. The diameter of the third collecting drum 25 may be equal to, or different from, the diameters d2, d3 of the collecting drums 2, 3. The provision of a third collecting drum 25 makes it possible to produce end products which differ from the end products 19 which can be produced in FIGS. 1 to 5. A possible manner of operation of the sheet-processing apparatus 1" will be described hereinbelow with reference to FIG. 7.

Figure 7:
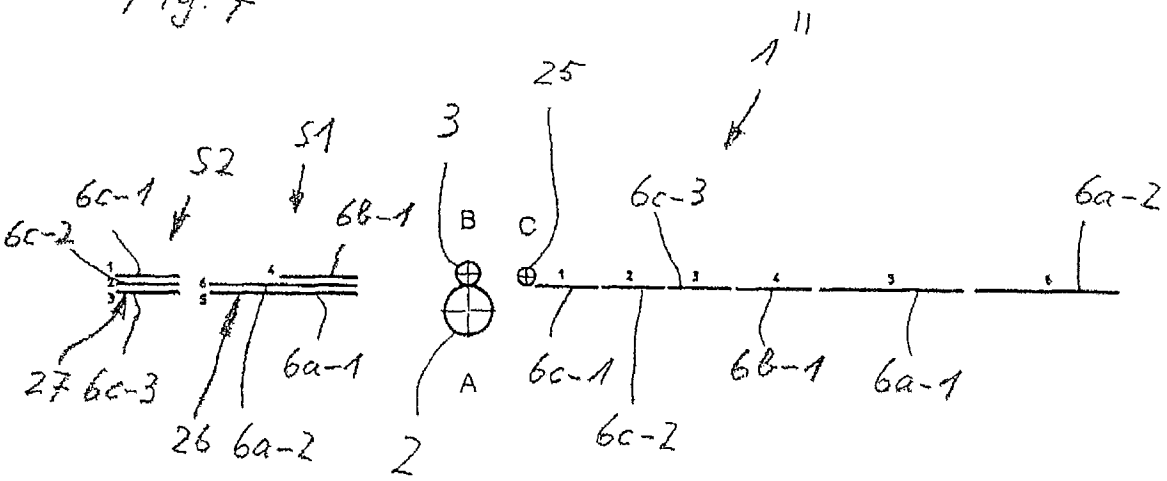
FIG. 7 shows a side view corresponding to FIG. 6, of a third embodiment of a processing apparatus according to the invention.

As FIG. 7 shows, the collecting drums 2, 3, 25, as seen in the conveying direction F, are fed in the first instance three sheets 6c-1, 6c-2 and 6c-3 of a third format, which, for the sake of simplicity, will be referred to hereinbelow as "additional sheets". These additional sheets 6c differ in format from the formats of the long sheets 6a and of the short sheets 6b. In the sheet stream fed to the collecting drums 2, 3, 25, the additional sheets 6c-1, 6c-2 and 6c-3 are followed by a short sheet 6b-1 and two long sheets 6a-1 and 6a-2.

Processing of the incoming sheets 6c, 6b, 6a proceeds as follows:

The additional sheets 6c-1 and 6c-2 are wound up onto the third collecting drum 25, and secured temporarily on the circumference thereof, in the manner already described with reference to FIGS. 2 to 6. The additional sheets 6c-1, 6c-2 are then detached from the collecting drum 25 and positioned on the third additional sheet 6c-3 as it moves past the third collecting drum 25. The resulting sheet stack is guided through between the collecting drums 2, 3 and removed for further processing. This sheet stack is illustrated on the left-hand side of FIG. 7 and designated by S2. In this sheet stack S2, the additional sheets 6c-3, 6c-2 and 6c-1 are located one above the other in this order such that they are aligned with one another by way of their side edges. The following sheets 6b-1, 6a-1, 6a-2 are guided past the third collecting drum 25. The short sheet 6b-1 is wound up onto the upper collecting drum 3 and the following, first long sheet 6a-1 is wound up onto the lower collecting drum 2. The second long sheet 6a-2 is guided through between the collecting drums 2, 3 and, at the same time, brought together with the short sheet 6b-1, detached from the collecting drum 3, and the first long sheet 6a-1, which is detached from the other collecting drum 2, as has been explained in more detail with reference to FIG. 2. The short sheet 6b-1 here is positioned on the second long sheet 6a-2 from above and the first long sheet 6a-1 is positioned thereon from beneath. The resulting sheet stack is removed for further processing. This sheet stack is illustrated on the left-hand side of FIG. 7 and designed by S1. In this sheet stack S1, the sheets 6a-1, 6a-2 and 6b-1 are located one above the other in this order such that they are aligned with one another by way of their side edges.

In the case of a preferred use example, the interim product 26 formed by the sheet stack S1 is a newspaper comprising two double pages, i.e. the long sheets 6a-1 and 6a-2, and a half-format, single page, i.e. the short sheet 6b-1. The double pages (sheets 6a-1 and 6a-2) have been printed with four pages of text and/or images, and the single page (sheet 6b-1) has been printed with two pages of text and/or images. The other interim product 27, formed by the sheet stack S2, is a supplement (periodical or brochure), preferably a tabloid. An end product is obtained by virtue of the interim product 27 (supplement) being inserted into the once-folded (as described with reference to FIG. 4d) interim product 26 (newspaper).

In addition to the aforementioned advantages and preferred variants of the method according to the invention and of the apparatus according to the invention, further particular aspects of the present invention will be pointed out hereinbelow.

In each case either just a single sheet 6 or a plurality of sheets 6 located one above the other, and forming a sheet stack S, can be secured (collected) on each of the collecting drums 2, 3, 25. It is possible here for a sheet stack S to be formed from sheets 6 of the same format or from sheets 6 of different formats. If the length of the circumference allows it, two or more sheets 6 or sheet stacks S can be secured at the same time on the circumference of a collecting drum 2, 3, 25, as is illustrated in FIG. 5 for the collecting drum 3.

In the case of the exemplary embodiments described with reference to FIGS. 2 to 7, the sheets 6 are brought together such that, in the resulting product 19, the sheets 6 are aligned with one another by way of their leading edges 6v. However, it is also possible for the sheets 6, when brought together, to be aligned with one another by way of their trailing, rear edges or by way of one of their side edges, extending in the feeding direction F. In addition, it is, of course, also possible to dispense altogether with alignment of the sheets 6.

The sheets 6 fed in a stream to the collecting drums 2, 3, 25 can also be used to produce, one after the other, products 19 which differ from one another in terms of composition, e.g. in terms of the number of sheets 6 or of the combination of sheets 6 of different formats.

The sheets 6 can be secured optionally on the any one of the collecting drums 2, 3, 25. It is not imperative for all the sheets 6 to be wound up onto the circumference of the collecting drums 2, 3, 25, because certain sheets 6 are guided through between the collecting drums 2, 3 and/or directed past the collecting drum 25, as has been explained with reference to FIGS. 2, 3, 5 and 7.

The sheets 6 fed to the collecting drums 2, 3, 25 may also have more than two or three different formats. The sheets 6 of different formats may be of the same width b and different format lengths y or the same format length y and different widths b.

Instead of, as described, a material web 14, from which the sheets 6 are then severed, being printed in a digital printing machine, it is also possible for the sheets to be printed directly in the digital machine.

The sheets 6 may be made of paper, plastics material, a textile material or any other suitable material.

A preferred area of use of the method according to the invention and of the sheet-processing apparatus according to the invention is the production of newspapers, periodicals, brochures and the like from sheets of different formats printed in a digital printing machine. However, the method according to the invention and the apparatus according to the invention can also be used to produce other products comprising sheets printed in a digital printing machine, e.g. calendars, lottery tickets and the like.

What is claimed is:

1. An apparatus for processing sheets of different formats, the apparatus comprising:

a feeding device configured to feed at least short sheets of a first, short format and long sheets of a second, long format in a feeding direction one behind the other, and at a certain conveying speed, the feeding device defining a conveying path for the sheets, at least two collecting drums disposed downstream of the feeding device, the at least two collecting drums having essentially cylindrical lateral surfaces configured to be rotated about an axis of rotation, securing means for temporarily securing the fed sheets on a circumference of the at least two collecting drums, a drive device configured to drive the collecting drums in rotation at a circumferential speed that corresponds essentially to the conveying speed of the feeding device, and a sensing device for sensing the fed sheets moving past, the sensing device being arranged along the conveying path upstream of the collecting drums and sensing leading edges of the short sheets and of the long sheets, as seen in the feeding direction, or markings applied to the short sheets and to the long sheets, the at least two collecting drums being synchronized during the feeding process with respect to the leading edges of the short sheets and the leading edges of the long sheets such that the leading edges of the short sheets and the leading edges of the long sheets are aligned with one another.

2. The apparatus as claimed in claim 1, further comprising a third collecting drum, which is disposed downstream of the feeding device and has an essentially cylindrical lateral surface configured to be rotated about an axis of rotation, and another securing means for temporarily securing the fed sheets on a circumference of the third collecting drum.

3. The apparatus as claimed in claim 1, wherein the securing means is for securing the fed sheets in a mechanical manner or for securing the fed sheets in an electrostatically charged manner.

4. The apparatus as claimed in claim 2, wherein the another securing means is for securing the fed sheets in a mechanical manner or for securing the fed sheets in an electrostatically charged manner.

* * * * *